US011313570B2

(12) United States Patent
Dong et al.

(10) Patent No.: US 11,313,570 B2
(45) Date of Patent: Apr. 26, 2022

(54) METHOD AND DEVICE FOR CONTROLLING ELECTRIC HEATING OF AIR CONDITIONER COMPRESSOR

(71) Applicant: GREE ELECTRIC APPLIANCES, INC. OF ZHUHAI, Guangdong (CN)

(72) Inventors: Mingzhu Dong, Guangdong (CN); Hui Zhang, Guangdong (CN); Qunbo Liu, Guangdong (CN); Yaodong Li, Guangdong (CN); Kai Yu, Guangdong (CN); Handong Xue, Guangdong (CN); Yingsheng Fu, Guangdong (CN); Ke Xu, Guangdong (CN); Fang Wang, Guangdong (CN); Yi Ni, Guangdong (CN)

(73) Assignee: GREE ELECTRIC APPLIANCES, INC. OF ZHUHAI, Guangdong (CN)

( * ) Notice: Subject to any disclaimer, the term of this patent is extended or adjusted under 35 U.S.C. 154(b) by 596 days.

(21) Appl. No.: 16/306,179

(22) PCT Filed: May 22, 2017

(86) PCT No.: PCT/CN2017/085340
§ 371 (c)(1),
(2) Date: Nov. 30, 2018

(87) PCT Pub. No.: WO2017/215407
PCT Pub. Date: Dec. 21, 2017

(65) Prior Publication Data

US 2021/0222899 A1 Jul. 22, 2021

(30) Foreign Application Priority Data

Jun. 13, 2016 (CN) ..... 201610415142.3

(51) Int. Cl.
*F25B 49/02* (2006.01)
*F24F 11/30* (2018.01)
(Continued)

(52) U.S. Cl.
CPC ..... *F24F 11/30* (2018.01); *F24F 11/64* (2018.01); *F25B 49/022* (2013.01);
(Continued)

(58) Field of Classification Search
CPC ..... F25B 49/022; F25B 2600/02; F24F 11/30; F24F 11/64; F24F 2130/10; F24F 2221/34
See application file for complete search history.

(56) References Cited

U.S. PATENT DOCUMENTS 4,004,431 A * 1/1977 Hildreth ..... F04B 49/10 62/228.1
2010/0211224 A1 8/2010 Keeling et al.
(Continued)

FOREIGN PATENT DOCUMENTS

CN 201129820 Y 10/2008
CN 102661267 A 9/2012
(Continued)

OTHER PUBLICATIONS

JP 2012-241916 (English Abstract) (Year: 2012).*
English Translation of International Search Report issued in PCT/CN2017/085340, dated Aug. 11, 2017, 2 pgs.

*Primary Examiner* — Jonathan Bradford
(74) *Attorney, Agent, or Firm* — Armstrong Teasdale LLP

(57) ABSTRACT

Provided are a method and device for controlling electric heating of an air conditioner compressor. The method may include: first request information is transmitted to a corresponding database server at an interval of a second preset duration, as to acquire weather forecast data of an area
(Continued)

where an air conditioner is located within an upcoming third preset duration; the weather forecast data returned by the database server is received and stored in a built-in database of the air conditioner; it is monitored to learn that a shutdown duration of the air conditioner compressor exceeds a first preset duration, as to acquire the weather forecast data stored in the built-in database of the air conditioner; and a control strategy is generated according to the weather forecast data, to control the air conditioner compressor to start and stop electric heating.

20 Claims, 5 Drawing Sheets

(51) Int. Cl.
*F24F 11/64* (2018.01)
*F24F 130/10* (2018.01)

(52) U.S. Cl.
CPC ..... *F24F 2130/10* (2018.01); *F24F 2221/34* (2013.01); *F25B 2600/02* (2013.01)

(56) References Cited

U.S. PATENT DOCUMENTS

| | | | |
|---|---|---|---|
| 2015/0167996 | A1 | 6/2015 | Fadell et al. |
| 2015/0276291 | A1 | 10/2015 | Pham et al. |

FOREIGN PATENT DOCUMENTS

| | | | |
|---|---|---|---|
| CN | 103234254 | A | 8/2013 |
| CN | 204086866 | U | 1/2015 |
| CN | 104864569 | A | 8/2015 |
| CN | 104913456 | A | 9/2015 |
| CN | 105508201 | A | 4/2016 |
| CN | 105509245 | A | 4/2016 |
| CN | 106091248 | A | 11/2016 |
| JP | 2012241916 | A | 12/2012 |
| KR | 20130005197 | A | 1/2013 |

* cited by examiner

METHOD AND DEVICE FOR CONTROLLING ELECTRIC HEATING OF AIR CONDITIONER COMPRESSOR

CROSS-REFERENCE TO RELATED APPLICATIONS

The present application is the national stage entry of International Patent Application No. PCT/CN2017/085340, filed on May 22, 2017, which claims the benefit of priority to Chinese Patent Application No. 201610415142.3, filed on Jun. 13, 2016, the contents of which are hereby incorporated by reference in their entirety.

TECHNICAL FIELD

The present disclosure relates to the technical field of air conditioners, in particular to a method and device for controlling electric heating of an air conditioner compressor.

BACKGROUND

In the related art, a refrigerant may enter into a compressor due to increase of outdoor environment when an air conditioner is shut down. However, a unit cannot pre-judge a change trend of outdoor environment in advance. In order to ensure reliability of the compressor of the unit, an electric heating belt of the compressor should always be enabled during a standby process. However, the power consumed by the electric heating belt of the compressor is more than 70% of a standby power of the whole machine, thereby leading to high energy consumption of a multi-split machine in a standby state. For a year as a whole, a standby time of a household multi-split machine is far greater than a running time, therefore, to reduce the standby power consumption of the electric heating belt of the compressor is the key of promoting the whole efficiency of use.

In allusion to the problem in the related art that the air conditioner compressor consumes a large amount of standby power because the compressor still needs a lot of electric heating when the air conditioner is in a standby state, no effective solution has been proposed yet till now.

SUMMARY

The present disclosure provides a method and device for controlling electric heating of an air conditioner compressor, to solve the problem in the related art that the air conditioner compressor consumes a large amount of standby power because the compressor still needs a lot of electric heating when an air conditioner is in a standby state.

In order to solve the above-mentioned technical problem, according to one aspect of an embodiment, the present disclosure provides a method for controlling electric heating of the air conditioner compressor, including: monitoring by a controller of the air conditioner, to learn that a shutdown operation of the air conditioner compressor exceeds a first preset duration, acquiring weather forecast data; and generating by the controller of the air conditioner, according to the weather forecast data, a control strategy to control to start and stop electric heating of the air conditioner compressor.

According to an example embodiment, wherein before monitoring by the controller of the air conditioner, to learn that the shutdown operation of the air conditioner compressor exceeds the first preset duration, the method further includes: transmitting by the controller of the air conditioner, first request information to a corresponding database server at an interval of a second preset duration so as to acquire the weather forecast data of an area where the air conditioner is located within an upcoming third preset duration; and receiving by the controller of the air conditioner, the weather forecast data returned by the database server and storing the weather forecast data in a built-in database of the air conditioner.

According to an example embodiment, wherein transmitting by the controller of the air conditioner, the first request information to the corresponding database server at the interval of the second preset duration so as to acquire the weather forecast data of the area where the air conditioner is located within the upcoming third preset duration includes: positioning the area where the air conditioner is located to determine location information of the air conditioner; acquiring the third preset duration threshold that is preset; and generating the first request information including the location information of the air conditioner and the third preset duration threshold, and transmitting the first request information to the database server to acquire the weather forecast data of the area where the air conditioner is located within the upcoming third preset duration.

According to an example embodiment, wherein generating by the controller of the air conditioner, according to the weather forecast data, the control strategy to control to start and stop electric heating of the air conditioner compressor includes: screening, from the weather forecast data stored in the built-in database of the air conditioner, weather forecast data within a fourth preset duration after a present time; and analyzing to determine a change trend along time of a temperature in the weather forecast data within the fourth preset duration, controlling to start electric heating of the air conditioner compressor within a duration during which an ascending trend is shown, and controlling to stop electric heating of the air conditioner compressor within a duration during which a non-ascending trend is shown.

According to an example embodiment, wherein analyzing to determine the change trend along time of the temperature in the weather forecast data within the fourth preset duration includes: dividing the fourth preset duration into n preset unit time periods equally, and recording as $F_1 \ldots F_k \ldots F_n$ respectively, where n and k are natural numbers, k being whole integers from 2 to n; calculating a mean temperature within each of n unit time periods $F_1 \ldots F_k \ldots F_n$, and recording as $t_1 \ldots t_k \ldots t_n$ respectively; and comparing the mean temperature within each current time period with the mean temperature within a time period immediately preceding the current time period so as to determine the change trend along time of the temperature in the weather forecast data within the fourth preset duration.

According to an example embodiment, wherein comparing the mean temperature within each current time period with the mean temperature within the time period immediately preceding the current time period so as to determine the change trend along time of the temperature in the weather forecast data within the fourth preset duration includes: determining that the change trend along time of the temperature within a $F_k$ time period is an ascending trend when $t_k - t_{(k-1)} > 0$, and determining that the change trend along time of the temperature within a $F_k$ time period is a non-ascending trend when $t_k - t_{(k-1)} > 0$.

According to an example embodiment, wherein k=n is indicative of the weather forecast data within the fourth preset duration being completely processed, and monitoring is continued to learn whether the shutdown duration of the air conditioner compressor exceeds the first preset duration.

According to one aspect of an embodiment, a device for controlling electric heating of an air conditioner compressor, including at least one processor and a computer readable storage, coupled to the at least one processor and storing at least one computer executable instruction thereon, which when the at least one computer executable instruction is executed by the at least one processor, causes the at least one processor to carry out following actions: monitoring by a controller of the air conditioner, to learn that a shutdown operation of the air conditioner compressor exceeds a first preset duration, acquiring weather forecast data; and generating by the controller of the air conditioner, according to the weather forecast data, a control strategy to control to start and stop electric heating of the air conditioner compressor.

According to an example embodiment, the actions further including: before monitoring by the controller of the air conditioner, to learn that the shutdown operation of the air conditioner compressor exceeds the first preset duration, transmitting by the controller of the air conditioner, first request information to a corresponding database server at an interval of a second preset duration so as to acquire the weather forecast data of an area where the air conditioner is located within an upcoming third preset duration; and receiving by the controller of the air conditioner the weather forecast data returned by the database server and storing the weather forecast data in a built-in database of the air conditioner.

According to an example embodiment, wherein transmitting by the controller of the air conditioner the first request information to the corresponding database server at the interval of the second preset duration so as to acquire the weather forecast data of the area where the air conditioner is located within the upcoming third preset duration includes: positioning the area where the air conditioner is located to determine location information of the air conditioner; acquiring the third preset duration threshold that is preset; and generating the first request information including the location information of the air conditioner and the third preset duration threshold, and transmitting to the database server to acquire the weather forecast data of the area where the air conditioner is located within the upcoming third preset duration.

According to an example embodiment, wherein generating by the controller of the air conditioner, according to the weather forecast data, the control strategy to control to start and stop electric heating of the air conditioner compressor includes: screening, from the weather forecast data stored in the built-in database of the air conditioner, weather forecast data within a fourth preset duration after a present time; and analyzing to determine a change trend along time of a temperature in the weather forecast data within the fourth preset duration, controlling to start electric heating of the air conditioner compressor within a duration during which an ascending trend is shown, and controlling to stop electric heating of the air conditioner compressor within a duration during which a non-ascending trend is shown.

According to an example embodiment, wherein analyzing to determine the change trend along time of the temperature in the weather forecast data within the fourth preset duration includes: dividing the fourth preset duration into n preset unit time periods equally, and recording as $F_1 \ldots F_k \ldots F_n$ respectively, where n and k are natural numbers, k being whole integers from 2 to n; calculating a mean temperature within each of n unit time periods $F_1 \ldots F_k \ldots F_n$, and recording as $t_1 \ldots t_k \ldots t_n$ respectively; and comparing the mean temperature within each current time period with the mean temperature within a time period immediately preceding the current time period so as to determine the change trend along time of the temperature in the weather forecast data within the fourth preset duration.

According to an example embodiment, wherein comparing the mean temperature within each current time period with the mean temperature within the time period immediately preceding the current time period so as to determine the change trend along time of the temperature in the weather forecast data within the fourth preset duration includes: determining that the change trend along time of the temperature within a $F_k$ time period is an ascending trend when $t_k-t_{(k-1)}>0$, and determining that the change trend along time of the temperature within a $F_k$ time period is a non-ascending trend when $t_k-t_{(k-1)}\leq 0$.

According to an example embodiment, wherein k=n is indicative of the weather forecast data within the fourth preset duration being completely processed, and monitoring is continued to learn whether the shutdown duration of the air conditioner compressor exceeds the first preset duration.

According to an example embodiment, wherein generating by the controller of the air conditioner, according to the weather forecast data, the control strategy to control to start and stop electric heating of the air conditioner compressor includes: screening, from the weather forecast data stored in the built-in database of the air conditioner, weather forecast data within a fourth preset duration after a present time; and analyzing to determine a change trend along time of a temperature in the weather forecast data within the fourth preset duration, controlling to start electric heating of the air conditioner compressor within a duration during which an ascending trend is shown, and controlling to stop electric heating of the air conditioner compressor within a duration during which a non-ascending trend is shown.

According to an example embodiment, wherein analyzing to determine the change trend along time of the temperature in the weather forecast data within the fourth preset duration includes: dividing the fourth preset duration into n preset unit time periods equally, and recording as $F_1 \ldots F_k \ldots F_n$ respectively, where n and k are natural numbers, k being whole integers from 2 to n; calculating a mean temperature within each of n unit time periods $F_1 \ldots F_k \ldots F_n$, and recording as $t_1 \ldots t_k \ldots t_n$ respectively; and comparing the mean temperature within each current time period with the mean temperature within a time period immediately preceding the current time period so as to determine the change trend along time of the temperature in the weather forecast data within the fourth preset duration.

According to an example embodiment, wherein comparing the mean temperature within each current time period with the mean temperature within the time period immediately preceding the current time period so as to determine the change trend along time of the temperature in the weather forecast data within the fourth preset duration includes: determining that the change trend along time of the temperature within a $F_k$ time period is an ascending trend when $t_k-t_{(k-1)}>0$, and determining that the change trend along time of the temperature within a $F_k$ time period is a non-ascending trend when $t_k-t_{(k-1)}\leq 0$.

According to an example embodiment, wherein k=n is indicative of the weather forecast data within the fourth preset duration being completely processed, and monitoring is continued to learn whether the shutdown duration of the air conditioner compressor exceeds the first preset duration.

According to an example embodiment, wherein generating by the controller of the air conditioner, according to the weather forecast data, the control strategy to control to start and stop electric heating of the air conditioner compressor includes: screening, from the weather forecast data stored in the built-in database of the air conditioner, weather forecast data within a fourth preset duration after a present time; and analyzing to determine a change trend along time of a temperature in the weather forecast data within the fourth preset duration, controlling to start electric heating of the air conditioner compressor within a duration during which an ascending trend is shown, and controlling to stop electric heating of the air conditioner compressor within a duration during which a non-ascending trend is shown.

According to an example embodiment, wherein analyzing to determine the change trend along time of the temperature in the weather forecast data within the fourth preset duration includes: dividing the fourth preset duration into n preset unit time periods equally, and recording as $F_1 \ldots F_k \ldots F_n$ respectively, where n and k are natural numbers, k being whole integers from 2 to n; calculating a mean temperature within each of n unit time periods $F_1 \ldots F_k \ldots F_n$, and recording as $t_1 \ldots t_k \ldots t_n$ respectively; and comparing the mean temperature within each current time period with the mean temperature within a time period immediately preceding the current time period so as to determine the change trend along time of the temperature in the weather forecast data within the fourth preset duration.

In the present disclosure, a communication component is configured inside the air conditioner for network communication. The communication component is able to connect and communicate with the database server including the weather data, and transmits the request information to the database server at the interval of preset time. The request information carries time request information and location request information of the area where the air conditioner is located, and the database server may return the weather forecast data required by the air conditioner. The air conditioner stores the weather forecast data returned by the database server in its own database. When the shutdown duration of the air conditioner compressor exceeds the first preset duration, the air conditioner calls the weather forecast data required in its own database directly, and takes the weather forecast data as a basis to judge whether the compressor is required to implement electric heating when the air conditioner is in a standby state. This control scheme solves the problem in the related art that the air conditioner compressor consumes a large amount of standby power because the compressor still needs a lot of electric heating when the air conditioner is in a standby state, while reducing an electric heating startup time when the air conditioner is in a standby state and reducing energy consumption.

DETAILED DESCRIPTION OF THE EMBODIMENTS

Exemplary embodiments are explained in detail here, and examples are shown in drawings. When the description below involves the drawings, identical numbers in different drawings shall represent identical or similar elements, unless otherwise stated. Modes of implementation described in the exemplary embodiments below shall not represent all modes of implementation which are consistent with the present disclosure. On the contrary, they are just examples of a device and method consistent with some aspects of the present disclosure expatiated in claims attached.

Embodiment 1

A method for controlling electric heating of an air conditioner compressor provided by the present disclosure is described below in combination with drawings.

Figure 1:
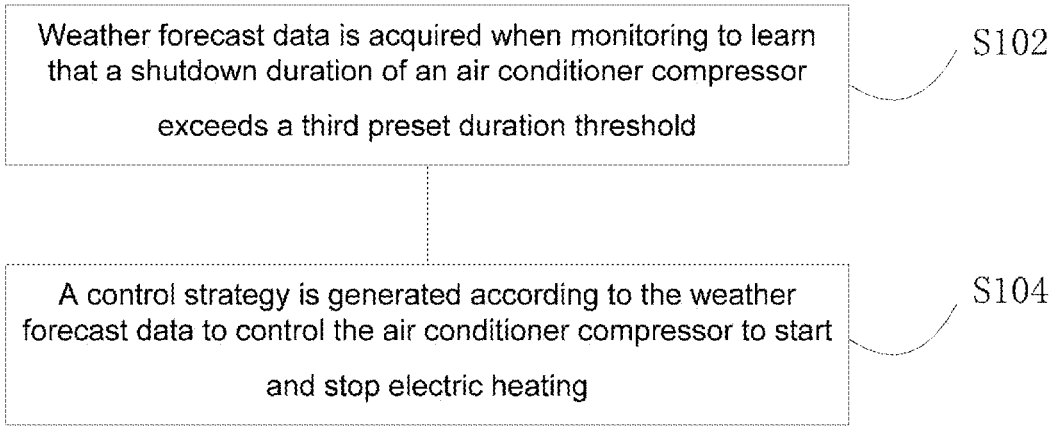
FIG. 1 is a preferred flowchart of a method for controlling electric heating of an air conditioner compressor according to an embodiment of the present disclosure.

The method for controlling electric heating of the air conditioner compressor provided by the present disclosure may be applied to a household air conditioner, and implemented on commercial air conditioners of malls and other places, or marine air conditioners. FIG. 1 shows a preferred flowchart of the method; as shown in FIG. 1, the method for controlling electric heating of the air conditioner compressor may include the following steps:

S102, When monitoring to learn that the shutdown duration of the air conditioner compressor exceeds a first preset duration, weather forecast data is acquired.

In an example embodiment, before monitoring to learn that the shutdown duration of the air conditioner compressor exceeds the first preset duration, the method further includes: first request information is transmitted to a corresponding database server at an interval of a second preset duration, as to acquire the weather forecast data of an area where an air conditioner is located within an upcoming third preset duration; and the weather forecast data returned by the database server is received and stored in a built-in database of the air conditioner.

In an example embodiment, through setting in advance, a built-in communication component of the air conditioner transmits the first request information to the database server at the interval of the first preset duration. In the example embodiment, the area where the air conditioner is located is positioned through the built-in communication component of the air conditioner, as to determine location information of the air conditioner; the third preset duration that is preset is acquired; the first request information including the location information of the air conditioner and the third preset duration is generated and transmitted to the database server, as to acquire the weather forecast data of the area where the air conditioner is located within the upcoming third preset duration; wherein the database server analyzes the first request information, accesses to a weather platform with its own network interface to acquire the weather forecast data corresponding to the first request information, and returns the weather forecast data to the communication component of the air conditioner.

S104, a control strategy is generated according to the weather forecast data to control the air conditioner compressor to start and stop electric heating.

During an example implementation, the weather forecast data within a fourth preset duration after a present time is screened from the weather forecast data acquired from the built-in database of the air conditioner; a change trend along the time, of a temperature in the weather forecast data within the fourth preset duration is analyzed and determined; and the air conditioner compressor is controlled to start electric heating within the duration during which an ascending trend is shown, and controlled to stop electric heating within the duration during which a non-ascending trend is shown.

A preferred embodiment of implementation of the present disclosure provides a simple and effective scheme for analyzing to determine the change trend along the time of the temperature in the weather forecast data within the fourth preset duration; In an example embodiment, the fourth preset duration is divided into n preset unit time periods equally, and recorded as $F_1 \ldots F_k \ldots F_n$ respectively, where n and k are natural numbers, and $k \in [2,n]$; a mean temperature within each of n unit time periods $F_1 \ldots F_k \ldots F_n$ is calculated, and recorded as $t_1 \ldots t_k \ldots t_n$ respectively; the mean temperature within each time period is compared with the mean temperature within the last time period of this time period, as to determine the change trend along the time, of the temperature in the weather forecast data within the fourth preset duration.

During the above-mentioned comparison, the scheme below may be taken to implement calculation and determination with a formula below:

it is determined that the change trend along the time, of the temperature within a $F_k$ time period is an ascending trend when $t_k - t_{(k-1)} > 0$; and it is determined that the change trend along the time, of the temperature within a $F_k$ time period is a non-ascending trend when $t_k - t_{(k-1)} \leq 0$.

In addition, when k=n, it is indicated that the weather forecast data within the first preset duration is processed completely, and monitoring is continued to learn whether the shutdown duration of the air conditioner compressor exceeds the first preset duration.

Figure 2:
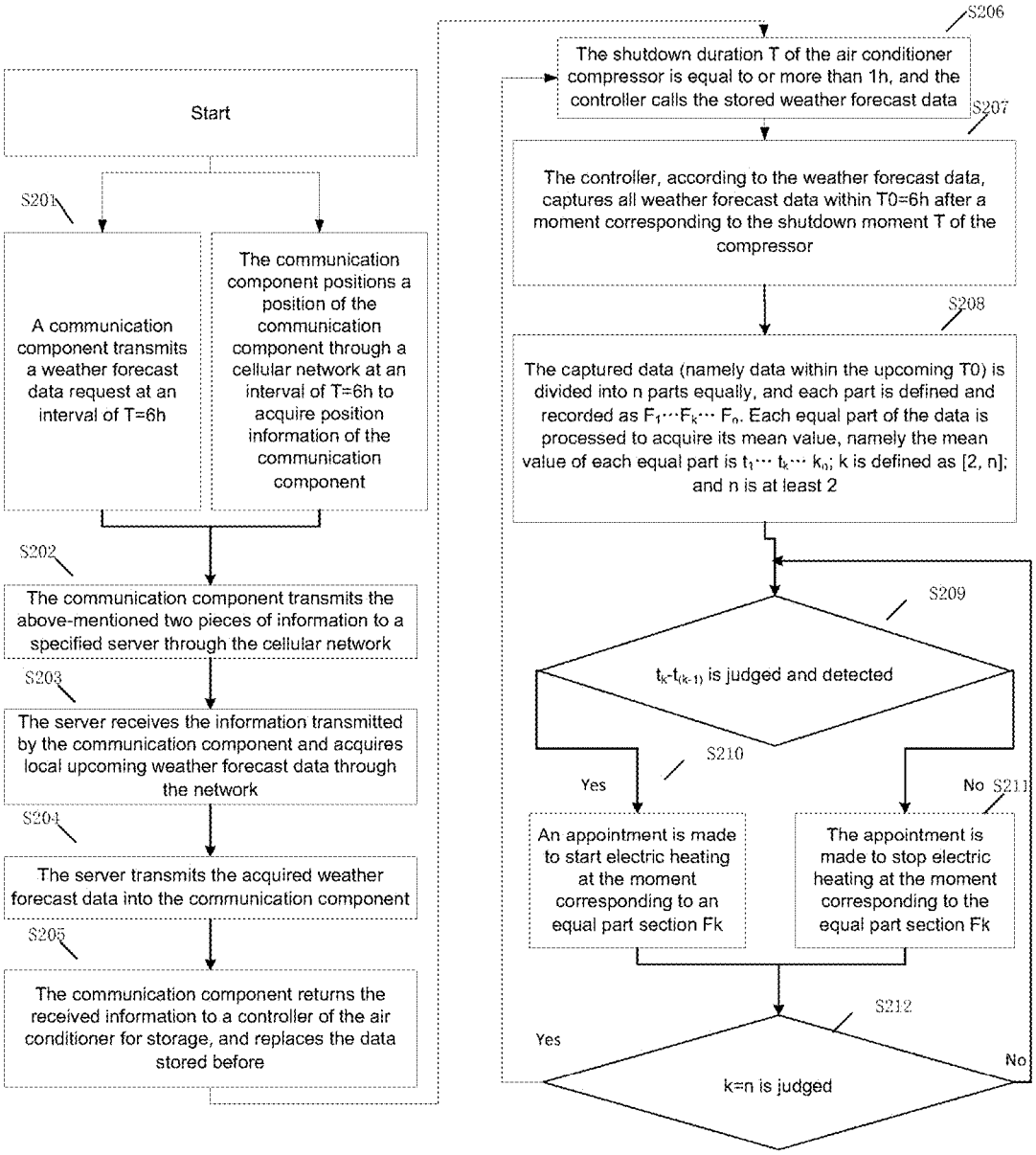
FIG. 2 is another preferred flowchart of a method for controlling electric heating of the air conditioner compressor according to an embodiment of the present disclosure.
Figure 3:
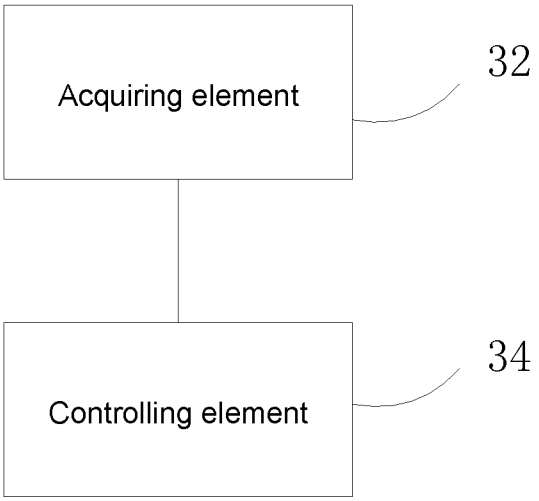
Figure 4:
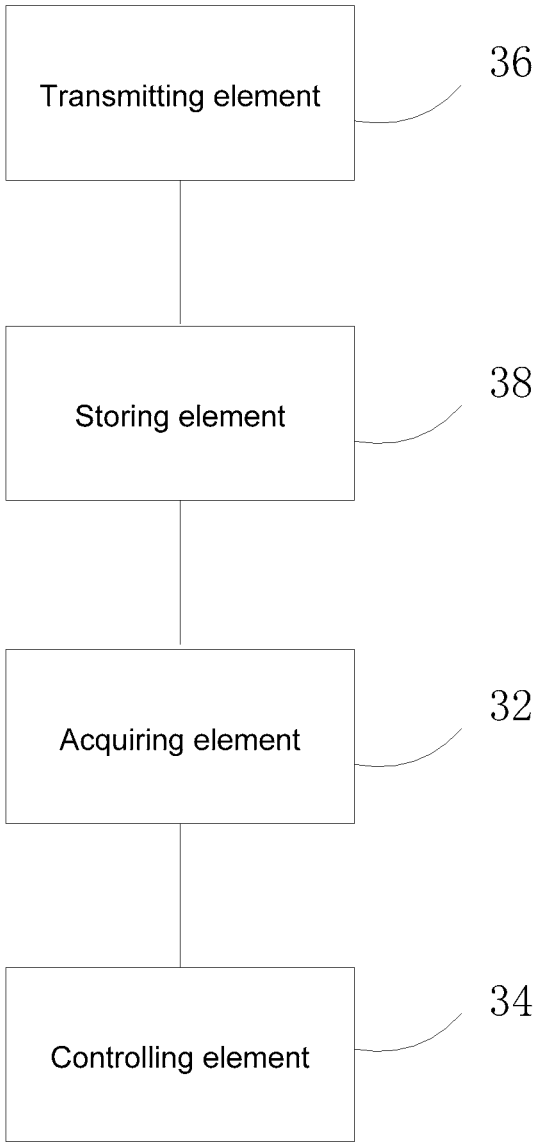
Figure 5:
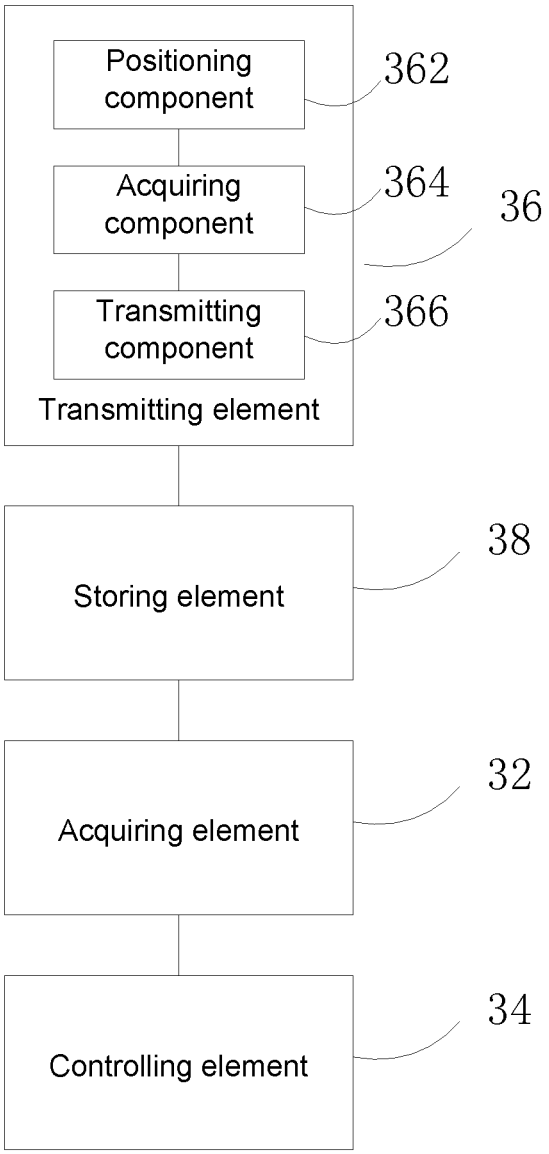
Figure 6:
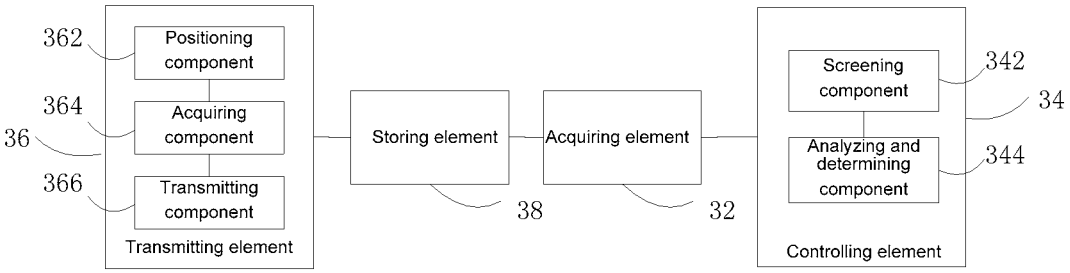

The method for controlling electric heating of the air conditioner compressor provided by the present disclosure will be further described below in combination with FIG. 2, so as to better understand the present disclosure.

S201, the communication component transmits a weather forecast data request at an interval of T=6 h, and positions position of the communication component through a cellular network at an interval of T=6 h, as to acquire position information of the communication component.

S202, the communication component transmits two pieces of information in S201 to a specified server (database server) through the cellular network.

S203, the server receives the information transmitted by the communication component and acquires local upcoming weather forecast data through the network.

S204, the server transmits the acquired weather forecast data into the communication component.

S205, the communication component returns the received information to a controller of the air conditioner for storage, and replaces the data stored before.

S206, a shutdown duration A of the compressor is monitored to learn to be equal to or more than 1 h, and the controller calls the stored weather forecast data.

S207, the controller, according to the weather forecast data, captures all weather forecast data within T0=6 h after a moment corresponding to the shutdown moment T of the compressor.

S208, the captured data (namely data within the upcoming T0) is divided into n parts equally, and each part is defined and recorded as $F_1 \ldots F_k \ldots F_n$. Each equal part of the data is processed to acquire the mean value of the part of the data, namely the mean value of each equal part is $t_1 \ldots t_k \ldots t_n$; k is defined as [2, n]; and n is at least 2.

S209, $t_k - t_{(k-1)} > 0$ is judged and detected, and if so, S210 is implemented, or S211 is implemented;

S210, an appointment is made to start electric heating at the moment corresponding to an equal part section $F_k$.

S211, an appointment is made to stop electric heating at the moment corresponding to the equal part section $F_k$;

S212, whether k is equal to n is judged, and if so, a skip to S202 is executed, or a skip to S209 is executed.

It may be seen from the above description that the communication component is configured inside the air conditioner in the present disclosure for network communication, and may be connected and communicated with the database server including the weather data. The communication component transmits the request information to the database server at the interval of the preset time. The request information carries time request information and location request information of the area where the air conditioner is located, and the database server may return the weather forecast data required by the air conditioner. The air conditioner stores the weather forecast data returned by the database server in the database of the air conditioner. When the shutdown duration of the air conditioner compressor exceeds the third first preset duration threshold, the weather forecast data required is called directly in the database of the air conditioner, and the weather forecast data is taken as a basis to judge whether the compressor is required to implement electric heating when the air conditioner is in a standby state. This control scheme solves the problem in the related art that the air conditioner compressor consumes a large amount of standby power because the compressor still needs a lot of electric heating when the air conditioner is in a standby state, while reducing the electric heating startup time when the air conditioner is in a standby state and reducing energy consumption.

Embodiment 2

Based on the method for controlling electric heating of the air conditioner compressor provided by the above-mentioned embodiment 1, a preferred embodiment 2 of the present disclosure further provides a device for controlling electric heating of an air conditioner compressor. In an example embodiment, the device for controlling electric heating of an air conditioner compressor, including at least one processor and a computer readable storage, coupled to the at least one processor and storing at least one computer executable instruction thereon, which when the at least one computer executable instruction is executed by the at least one processor, causes the at least one processor to carry out following actions: monitoring by a controller of the air conditioner, to learn that a shutdown operation of the air conditioner compressor exceeds a first preset duration, acquiring weather forecast data; and generating by the controller of the air conditioner, according to the weather forecast data, a control strategy to control to start and stop electric heating of the air conditioner compressor.

In an example, the actions further including: before monitoring by the controller of the air conditioner, to learn that the shutdown operation of the air conditioner compressor exceeds the first preset duration, transmitting by the controller of the air conditioner, first request information to a corresponding database server at an interval of a second preset duration so as to acquire the weather forecast data of an area where the air conditioner is located within an upcoming third preset duration; and receiving by the controller of the air conditioner the weather forecast data returned by the database server and storing the weather forecast data in a built-in database of the air conditioner.

In an example, transmitting by the controller of the air conditioner the first request information to the corresponding database server at the interval of the second preset duration so as to acquire the weather forecast data of the area where the air conditioner is located within the upcoming third preset duration includes: positioning the area where the air conditioner is located to determine location information of the air conditioner; acquiring the third preset duration threshold that is preset; and generating the first request information including the location information of the air conditioner and the third preset duration threshold, and transmitting to the database server to acquire the weather forecast data of the area where the air conditioner is located within the upcoming third preset duration.

In an example, generating by the controller of the air conditioner, according to the weather forecast data, the control strategy to control to start and stop electric heating of the air conditioner compressor includes: screening, from the weather forecast data stored in the built-in database of the air conditioner, weather forecast data within a fourth preset duration after a present time; and analyzing to determine a change trend along time of a temperature in the weather forecast data within the fourth preset duration, controlling to start electric heating of the air conditioner compressor within a duration during which an ascending trend is shown, and controlling to stop electric heating of the air conditioner compressor within a duration during which a non-ascending trend is shown.

In an example, analyzing to determine the change trend along time of the temperature in the weather forecast data within the fourth preset duration includes: dividing the fourth preset duration into n preset unit time periods equally, and recording as $F_1 \ldots F_k \ldots F_n$ respectively, where n and k are natural numbers, k being whole integers from 2 to n; calculating a mean temperature within each of n unit time periods and recording as $t_1 \ldots t_k \ldots t_n$ respectively; and comparing the mean temperature within each current time period with the mean temperature within a time period immediately preceding the current time period so as to determine the change trend along time of the temperature in the weather forecast data within the fourth preset duration.

In an example, comparing the mean temperature within each current time period with the mean temperature within the time period immediately preceding the current time period so as to determine the change trend along time of the temperature in the weather forecast data within the fourth preset duration includes: determining that the change trend along time of the temperature within a $F_k$ time period is an ascending trend when $t_k-t_{(k-1)}>0$; and determining that the change trend along time of the temperature within a $F_k$ time period is a non-ascending trend when $t_k-t_{(k-1)}\leq 0$.

In an example, k=n is indicative of the weather forecast data within the fourth preset duration being completely processed, and monitoring is continued to learn whether the shutdown duration of the air conditioner compressor exceeds the first preset duration.

In an example, generating by the controller of the air conditioner, according to the weather forecast data, the control strategy to control to start and stop electric heating of the air conditioner compressor includes: screening, from the weather forecast data stored in the built-in database of the air conditioner, weather forecast data within a fourth preset duration after a present time; and analyzing to determine a change trend along time of a temperature in the weather forecast data within the fourth preset duration, controlling to start electric heating of the air conditioner compressor within a duration during which an ascending trend is shown, and controlling to stop electric heating of the air conditioner compressor within a duration during which a non-ascending trend is shown.

In an example, analyzing to determine the change trend along time of the temperature in the weather forecast data within the fourth preset duration includes: dividing the fourth preset duration into n preset unit time periods equally, and recording as $F_1 \ldots F_k \ldots F_n$ respectively, where n and k are natural numbers, k being whole integers from 2 to n; calculating a mean temperature within each of n unit time periods and recording as $t_1 \ldots t_k \ldots t_n$ respectively; and comparing the mean temperature within each current time period with the mean temperature within a time period immediately preceding the current time period so as to determine the change trend along time of the temperature in the weather forecast data within the fourth preset duration.

In an example, comparing the mean temperature within each current time period with the mean temperature within the time period immediately preceding the current time period so as to determine the change trend along time of the temperature in the weather forecast data within the fourth preset duration includes: determining that the change trend along time of the temperature within a $F_k$ time period is an ascending trend when $t_k-t_{(k-1)}>0$, and determining that the change trend along time of the temperature within a $F_k$ time period is a non-ascending trend when $t_k-t_{(k-1)}\leq 0$.

In an example, k=n is indicative of the weather forecast data within the fourth preset duration being completely processed, and monitoring is continued to learn whether the shutdown duration of the air conditioner compressor exceeds the first preset duration.

In an example, generating by the controller of the air conditioner, according to the weather forecast data, the control strategy to control to start and stop electric heating of the air conditioner compressor includes: screening, from the weather forecast data stored in the built-in database of the air conditioner, weather forecast data within a fourth preset duration after a present time; and analyzing to determine a change trend along time of a temperature in the weather forecast data within the fourth preset duration, controlling to start electric heating of the air conditioner compressor within a duration during which an ascending trend is shown, and controlling to stop electric heating of the air conditioner compressor within a duration during which a non-ascending trend is shown.

In an example, analyzing to determine the change trend along time of the temperature in the weather forecast data within the fourth preset duration includes: dividing the fourth preset duration into n preset unit time periods equally, and recording as $F_1 \ldots F_k \ldots F_n$ respectively, where n and k are natural numbers, k being whole integers from 2 to n; calculating a mean temperature within each of n unit time periods and recording as $t_1 \ldots t_k \ldots t_n$ respectively; and comparing the mean temperature within each current time period with the mean temperature within a time period immediately preceding the current time period so as to determine the change trend along time of the temperature in the weather forecast data within the fourth preset duration.

As for the device in the above-mentioned embodiments, specific ways for all units and modules to implement operations have been described in detail in the embodiments related to the method, which will not be elaborated here.

It is easy for those skilled in the art to think of other embodiments of the present disclosure after considering the description and practicing the present disclosure disclosed here. The application aims to cover any variations, uses or adaptive changes of the present disclosure, and these variations, uses or adaptive changes should comply with the general principle of the present disclosure and include common general knowledge or conventional technical means of this technical field that are not invented by the present disclosure. The description and embodiments are only regarded as exemplary, and the real scope and spirit of the present disclosure will be indicated in claims below.

It is to be understood that the present disclosure is not limited in the accurate structure described above and shown in the drawings, and any modification and changes may be implemented without breaking away from its scope. Further, the scope of the present disclosure shall be limited by the claims attached only.

What is claimed is:

1. A method for controlling electric heating of an air conditioner compressor, comprising:

monitoring, by a controller of the air conditioner, to learn that a shutdown operation of the air conditioner compressor exceeds a first preset duration, acquiring weather forecast data; and generating, by the controller of the air conditioner, according to the weather forecast data, a control strategy to control starting and stopping electric heating of the air conditioner compressor.

2. The method for controlling electric heating of an air conditioner compressor of claim 1, wherein before monitoring, by the controller of the air conditioner, to learn that the shutdown operation of the air conditioner compressor exceeds the first preset duration, the method further comprises:

transmitting, by the controller of the air conditioner, first request information to a corresponding database server at an interval of a second preset duration so as to acquire the weather forecast data of an area where the air conditioner is located within an upcoming third preset duration; and receiving, by the controller of the air conditioner, the weather forecast data returned by the database server and storing the weather forecast data in a built-in database of the air conditioner.

3. The method for controlling electric heating of an air conditioner compressor of claim 2, wherein transmitting, by the controller of the air conditioner, the first request information to the corresponding database server at the interval of the second preset duration so as to acquire the weather forecast data of the area where the air conditioner is located within the upcoming third preset duration comprises:

determining location information of the air conditioner;

acquiring the third preset duration threshold that is preset; and generating the first request information including the location information of the air conditioner and the third preset duration threshold, and transmitting the first request information to the database server to acquire the weather forecast data of the area where the air conditioner is located within the upcoming third preset duration.

4. The method for controlling electric heating of an air conditioner compressor of claim 2, wherein generating, by the controller of the air conditioner, according to the weather forecast data, the control strategy to control starting and stopping electric heating of the air conditioner compressor comprises:

screening, from the weather forecast data stored in the built-in database of the air conditioner, weather forecast data within a fourth preset duration after a present time; and analyzing to determine a change trend along time of a temperature in the weather forecast data within the fourth preset duration, controlling starting electric heating of the air conditioner compressor within a duration during which an ascending trend is shown, and controlling stopping electric heating of the air conditioner compressor within a duration during which a non-ascending trend is shown.

5. The method for controlling electric heating of an air conditioner compressor of claim 4, wherein analyzing to determine the change trend along time of the temperature in the weather forecast data within the fourth preset duration comprises:

dividing the fourth preset duration into n preset unit time periods equally, and recording as F1 . . . Fk . . . Fn respectively, where n and k are natural numbers, k being whole integers from 2 to n;

calculating a mean temperature within each of n unit time periods F1 . . . Fk . . . Fn, and recording as t1 . . . tk . . . tn respectively; and comparing the mean temperature within each current time period with the mean temperature within a time period immediately preceding the current time period so as to determine the change trend along time of the temperature in the weather forecast data within the fourth preset duration.

6. The method for controlling electric heating of an air conditioner compressor of claim 5, wherein comparing the mean temperature within each current time period with the mean temperature within the time period immediately preceding the current time period so as to determine the change trend along time of the temperature in the weather forecast data within the fourth preset duration comprises:

determining that the change trend along time of the temperature within a Fk time period is an ascending trend when $tk-t(k-1)>0$; and determining that the change trend along time of the temperature within a Fk time period is a non-ascending trend when $tk-t(k-1)\leq 0$.

7. The method for controlling electric heating of an air conditioner compressor of claim 6, wherein is indicative of the weather forecast data within the fourth preset duration being completely processed, and monitoring is continued to learn whether the shutdown duration of the air conditioner compressor exceeds the first preset duration.

8. A device for controlling electric heating of an air conditioner compressor, comprising at least one processor and a computer readable storage, coupled to the at least one processor and storing at least one computer executable instruction thereon, which when the at least one computer executable instruction is executed by the at least one processor, causes the at least one processor to carry out following actions:

monitoring by a controller of the air conditioner, to learn that a shutdown operation of the air conditioner compressor exceeds a first preset duration, acquiring weather forecast data; and generating by the controller of the air conditioner, according to the weather forecast data, a control strategy to control starting and stopping electric heating of the air conditioner compressor.

9. The device for controlling electric heating of an air conditioner compressor of claim 8, the actions further comprising:

before monitoring by the controller of the air conditioner, to learn that the shutdown operation of the air conditioner compressor exceeds the first preset duration, transmitting by the controller of the air conditioner, first request information to a corresponding database server at an interval of a second preset duration so as to acquire the weather forecast data of an area where the air conditioner is located within an upcoming third preset duration; and receiving by the controller of the air conditioner the weather forecast data returned by the database server and storing the weather forecast data in a built-in database of the air conditioner.

10. The device for controlling electric heating of an air conditioner compressor of claim 9, wherein transmitting by the controller of the air conditioner the second request information to the corresponding database server at the interval of the first preset duration so as to acquire the weather forecast data of the area where the air conditioner is located within the upcoming third preset duration comprises:

determining location information of the air conditioner;

acquiring the third preset duration threshold that is preset; and generating the first request information including the location information of the air conditioner and the third preset duration threshold, and transmitting to the database server to acquire the weather forecast data of the area where the air conditioner is located within the upcoming third preset duration.

11. The device for controlling electric heating of an air conditioner compressor of claim 9, wherein generating by the controller of the air conditioner, according to the weather forecast data, the control strategy to control starting and stopping electric heating of the air conditioner compressor comprises:

screening, from the weather forecast data stored in the built-in database of the air conditioner, weather forecast data within a fourth preset duration after a present time; and analyzing to determine a change trend along time of a temperature in the weather forecast data within the fourth preset duration, controlling starting electric heating of the air conditioner compressor within a duration during which an ascending trend is shown, and controlling stopping electric heating of the air conditioner compressor within a duration during which a non-ascending trend is shown.

12. The device for controlling electric heating of an air conditioner compressor of claim 11, wherein analyzing to determine the change trend along time of the temperature in the weather forecast data within the fourth preset duration comprises:

dividing the fourth preset duration into n preset unit time periods equally, and recording as $F_1 \ldots F_k \ldots F_n$ respectively, where n and k are natural numbers, k being whole integers from 2 to n;

calculating a mean temperature within each of n unit time periods $F_1 \ldots F_k \ldots F_n$, and recording as $t_1 \ldots t_k \ldots t_n$ respectively; and comparing the mean temperature within each current time period with the mean temperature within a time period immediately preceding the current time period so as to determine the change trend along time of the temperature in the weather forecast data within the fourth preset duration.

13. The device for controlling electric heating of an air conditioner compressor of claim 12, wherein comparing the mean temperature within each current time period with the mean temperature within the time period immediately preceding the current time period so as to determine the change trend along time of the temperature in the weather forecast data within the fourth preset duration comprises:

determining that the change trend along time of the temperature within a $F_k$ time period is an ascending trend when $t_k-t_{(k-1)}>0$; and determining that the change trend along time of the temperature within a $F_k$ time period is a non-ascending trend when $t_k-t_{(k-1)}\leq 0$.

14. The device for controlling electric heating of an air conditioner compressor of claim 12, wherein k=n is indicative of the weather forecast data within the fourth preset duration being completely processed, and monitoring is continued to learn whether the shutdown duration of the air conditioner compressor exceeds the first preset duration.

15. The method for controlling electric heating of an air conditioner compressor of claim 3, wherein generating by the controller of the air conditioner, according to the weather forecast data, the control strategy to control starting and stopping electric heating of the air conditioner compressor comprises:

screening, from the weather forecast data stored in the built-in database of the air conditioner, weather forecast data within a fourth preset duration after a present time; and analyzing to determine a change trend along time of a temperature in the weather forecast data within the fourth preset duration, controlling starting electric heating of the air conditioner compressor within a duration during which an ascending trend is shown, and controlling stopping electric heating of the air conditioner compressor within a duration during which a non-ascending trend is shown.

16. The method for controlling electric heating of an air conditioner compressor of claim 15, wherein analyzing to determine the change trend along time of the temperature in the weather forecast data within the fourth preset duration comprises:

dividing the fourth preset duration into n preset unit time periods equally, and recording as $F_1 \ldots F_k \ldots F_n$ respectively, where n and k are natural numbers, k being whole integers from 2 to n;

calculating a mean temperature within each of n unit time periods $F_1 \ldots F_k \ldots F_n$, and recording as $t_1 \ldots t_k \ldots t_n$ respectively; and comparing the mean temperature within each current time period with the mean temperature within a time period immediately preceding the current time period so as to determine the change trend along time of the temperature in the weather forecast data within the fourth preset duration.

17. The method for controlling electric heating of an air conditioner compressor of claim 16, wherein comparing the mean temperature within each current time period with the mean temperature within the time period immediately preceding the current time period so as to determine the change trend along time of the temperature in the weather forecast data within the fourth preset duration comprises:

determining that the change trend along time of the temperature within a $F_k$ time period is an ascending trend when $t_k-t_{(k-1)}>0$; and determining that the change trend along time of the temperature within a $F_k$ time period is a non-ascending trend when $t_k-t_{(k-1)}\leq 0$.

18. The method for controlling electric heating of an air conditioner compressor of claim 17, wherein k=n is indicative of the weather forecast data within the fourth preset duration being completely processed, and monitoring is continued to learn whether the shutdown duration of the air conditioner compressor exceeds the first preset duration.

19. The device for controlling electric heating of an air conditioner compressor of claim 10, wherein generating by the controller of the air conditioner, according to the weather forecast data, the control strategy to control starting and stopping electric heating of the air conditioner compressor comprises:

screening, from the weather forecast data stored in the built-in database of the air conditioner, weather forecast data within a fourth preset duration after a present time; and analyzing to determine a change trend along time of a temperature in the weather forecast data within the fourth preset duration, controlling starting electric heating of the air conditioner compressor within a duration during which an ascending trend is shown, and controlling stopping electric heating of the air conditioner compressor within a duration during which a non-ascending trend is shown.

20. The device for controlling electric heating of an air conditioner compressor of claim 19, wherein analyzing to determine the change trend along time of the temperature in the weather forecast data within the fourth preset duration comprises:

dividing the fourth preset duration into n preset unit time periods equally, and recording as $F_1 \ldots F_k \ldots F_n$ respectively, where n and k are natural numbers, k being whole integers from 2 to n;

calculating a mean temperature within each of n unit time periods $F_1 \ldots F_k \ldots F_n$, and recording as $t_1 \ldots t_k \ldots t_n$ respectively; and comparing the mean temperature within each current time period with the mean temperature within a time period immediately preceding the current time period so as to determine the change trend along time of the temperature in the weather forecast data within the fourth preset duration.

* * * * *